US008668357B2

(12) United States Patent
Domingo Garcia

(10) Patent No.: US 8,668,357 B2
(45) Date of Patent: Mar. 11, 2014

(54) LUMINAIRE WITH LED TECHNOLOGY AND METHOD FOR OBTAINING SAID LUMINAIRE

(75) Inventor: Moisés Domingo Garcia, Boecillo (ES)

(73) Assignee: Luxintec, S.L. (ES)

( * ) Notice: Subject to any disclaimer, the term of this patent is extended or adjusted under 35 U.S.C. 154(b) by 0 days.

(21) Appl. No.: 13/635,576

(22) PCT Filed: Mar. 15, 2010

(86) PCT No.: PCT/ES2010/070152

§ 371 (c)(1),
(2), (4) Date: Nov. 21, 2012

(87) PCT Pub. No.: WO2011/113966

PCT Pub. Date: Sep. 22, 2011

(65) Prior Publication Data

US 2013/0063940 A1 Mar. 14, 2013

(51) Int. Cl.
*F21V 7/22* (2006.01)

(52) U.S. Cl.
USPC ..... 362/249.02; 362/296.02; 362/297; 362/307; 362/311.02

(58) Field of Classification Search
USPC ..... 362/297–300, 307, 309, 311.02, 327, 362/330, 340, 347, 235, 249.01, 249.02, 362/296.02
See application file for complete search history.

(56) References Cited

U.S. PATENT DOCUMENTS 5,698,866 A * 12/1997 Doiron et al. ..... 257/99
2008/0310158 A1* 12/2008 Harbers et al. ..... 362/240

FOREIGN PATENT DOCUMENTS

JP 2005166426 A 6/2005
JP 2006344564 A 12/2006

OTHER PUBLICATIONS

International Search Report; International Application No: PCT/ES2010/070152; International Application Filing Date Mar. 15, 2010; Mail date Nov. 24, 2011.

* cited by examiner

*Primary Examiner* — Thomas Sember
(74) *Attorney, Agent, or Firm* — Cantor Colburn LLP

(57) ABSTRACT

The invention relates to a luminaire with LED technology, which comprises a power supply, wiring, a plurality of electronic components (7), a translucent or transparent closure (5), a protective housing (3) for the lighting system, and at least one electronic base plate (1) having a plurality of LEDs (2), the luminaire being characterized in that it comprises a thin film which is made of highly reflective material and is applied to at least 5% of a first surface (4*a*) defined by the surface of said at least one electronic base plate (1) and the electronic components (7) adjacent thereto; and/or is applied to at least 5% of a second surface (4*b*) defined by the inner surface of the protective housing (3) between said at least one electronic base plate (1) and the translucent or transparent closure (5).

5 Claims, 2 Drawing Sheets

LUMINAIRE WITH LED TECHNOLOGY AND METHOD FOR OBTAINING SAID LUMINAIRE

TECHNICAL FIELD OF THE INVENTION

The present invention relates to a luminaire type lighting system with LED technology and to the method for obtaining said luminaire with LED technology, applicable in various domestic and professional sectors such as industry, shopping malls, restaurants, hotels, etc. The luminaire with LED technology has a luminous efficiency greater than 90% with the subsequent energy exploitation of the power supply of the lighting system by means of applying a thin film made of a highly reflective material optimizing material consumption and reducing manufacturing costs.

BACKGROUND OF THE INVENTION

Various lighting systems using LED technology are known today for reducing power supply consumption with respect to conventional lighting systems which use incandescent, discharge or fluorescent lamps.

The generic architecture of a method for manufacturing a lighting system using LED technology is organized into common parts: There is an electronic base plate or PCB where the LEDs and other electronic components required by the LEDs for power supply and control are coupled. The electronic base plate is assembled in a plastic or aluminum housing that acts as a support and aids in sealing and protecting the electronic base plate, the LEDs and the rest of the elements inside the luminaire. A transparent or translucent closure is then used for protecting and covering the LEDs in the area where they emit light while at the same time allowing the light emitted by the LEDs to exit the product producing the desired lighting effect.

A thorough study of lighting systems using LED technology allows determining that a significant amount of light emitted by the LEDs is diffusely reflected on the components closest to said LEDs, see for example the surface of the electronic base plate, the housing for the lighting system, or even the translucent closure protecting the LEDs from external agents, etc.

Diffuse reflection on the mentioned components causes them to absorb part of the light emitted by the LEDs, and therefore the light emitted from the system is not 100% the light emitted by the LEDs, rather in a typical application the light transmittance is 70%.

Likewise methods which allows increasing light transmittance in lighting systems with LED technology, which are normally made by means of including auxiliary parts that are white in color or metal plated with a high level of reflectance placed on the PCB are known, these methods result in the inclusion of additional parts which occupy space and have a high assembly cost and price.

Other known methods consist of encapsulating the LEDs and all the internal components adjacent thereto with a white colored material encompassing the mentioned internal components without covering the LEDs or blocking the area where they emit light, in this case, these methods have the main drawback of requiring a large amount of material having a high acquisition cost, they further include the drawback that once the LEDs and the internal components are encapsulated, the viewing of the preceding elements and the access thereto for possible repair in the event of failure or breakdown are prevented, in addition to preventing the inclusion of new components such as secondary optics in successive steps of the manufacturing process primarily due to the lack of free surfaces in the lighting system.

DESCRIPTION OF THE INVENTION

A first aspect of the present invention relates to a luminaire type lighting system with LED technology, and a second aspect relates to the method for obtaining said luminaire with LED technology which allows obtaining a luminous efficiency greater than 90% with the subsequent energy exploitation of the power supply of the lighting system by means of applying a thin film made of a highly reflective material optimizing material consumption and reducing manufacturing costs.

The luminaire with LED technology comprises a power supply, wiring, a plurality of electronic components, a translucent or transparent closure, a protective housing for the lighting system and at least one electronic base plate having a plurality of LEDs, the luminaire being characterized in that it comprises three surfaces:

a first surface defined by the surface of said at least one electronic base plate and the electronic components adjacent thereto, a second surface defined by the inner surface of the protective housing comprised between said at least one electronic base plate and the transparent or translucent closure, and a third surface defined by the inner surface of the transparent or translucent closure, such that a thin film made of a highly reflective material is applied to at least 5% of the first surface and/or to at least 5% of the second surface. The reflective film can thus be applied on both surfaces in their entirety with the subsequent improvement in the luminous efficiency of the luminaire.

More specifically, the thin film made of a highly reflective material is selectively deposited, i.e., the highly reflective thin film is applied only in areas where, if light reflected by the closure or the secondary optics is received, the light can be harnessed and reflected on the closure again in one or in successive reflections.

When evaluating the partial or complete application of the highly reflective film, a method is followed where if the highly reflective film is not applied then the luminaire generally has a typical light reflectance index of 70%; the light reflectance index from 70% to approximately 100% depends on the choice of the percentage of surface to which the highly reflective film will be applied.

There may be 4 different cases of luminaires to which the highly reflective film is applied:

1. a luminaire having only the first surface where in this case it makes no sense to apply the highly reflective film, 2. a luminaire having the first and the third surface, 3. a luminaire having the first and the second surface, where in this case it makes no sense to apply the highly reflective film and 4. a luminaire having the first, the second and the third surface;

therefore the highly reflective film is applied to at least 5% of any surface according to the type of luminaire and the desired reflectance index.

The possibility that the thin film made of a highly reflective material has a reflectance index of not less than 60% is contemplated; the components adjacent to the LEDs will therefore reflect the light emitted by the LEDs again, improving the luminous efficiency of the luminaire.

The possibility that the film made of a highly reflective material has an average thickness of not more than 500 micrometers is additionally contemplated to thus achieve a significant material saving in addition to occupying less space for the possible inclusion of new components and/or secondary optics.

The thin film made of a highly reflective material can optionally have physicochemical characteristics protecting the components in contact therewith from oxidation and aging, with the subsequent advantage of increasing the reliability and durability of the product obtained.

There can additionally be a thin film made of standard protective material between said at least one electronic base plate and between the thin film made of a highly reflective material; said thin film made of standard protective material will be used if the layer made of a highly reflective material was corrosive or was not sticky enough or if it is an electricity conductor and may cause lighting system failures.

A second aspect of the present invention comprises the method for obtaining a luminaire with LED technology according to the aforementioned features.

Therefore, according to the described invention, the luminaire with LED technology proposed by the invention is an advancement in luminaires and an improvement of the energy efficiency in luminaires used until now, and it fully solves the aforementioned problem in a satisfactory manner in terms of allowing reducing the costs of including a highly reflective material, reducing manufacturing costs, all this with simple and versatile manufacturing processes, which even allows the incorporation thereof into the already existing luminaires with LED technology.

DESCRIPTION OF THE DRAWINGS

To complement the description that is being made and for the purpose of aiding to better understand the features of the invention according to a preferred practical embodiment thereof, a set of drawings is attached as an integral part of said description in which the following has been depicted with an illustrative and non-limiting character.

PREFERRED EMBODIMENT OF THE INVENTION

Figure 1:
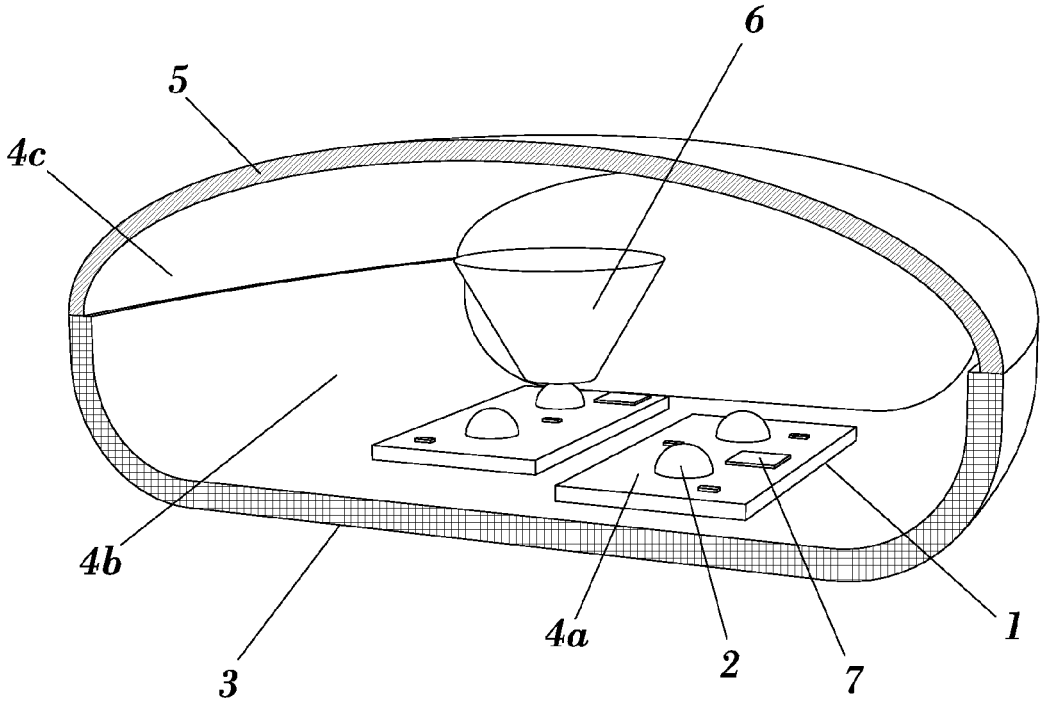
FIG. 1 shows a schematic three-dimensional perspective view of a luminaire with LED technology with a cross-section.
Figure 2:
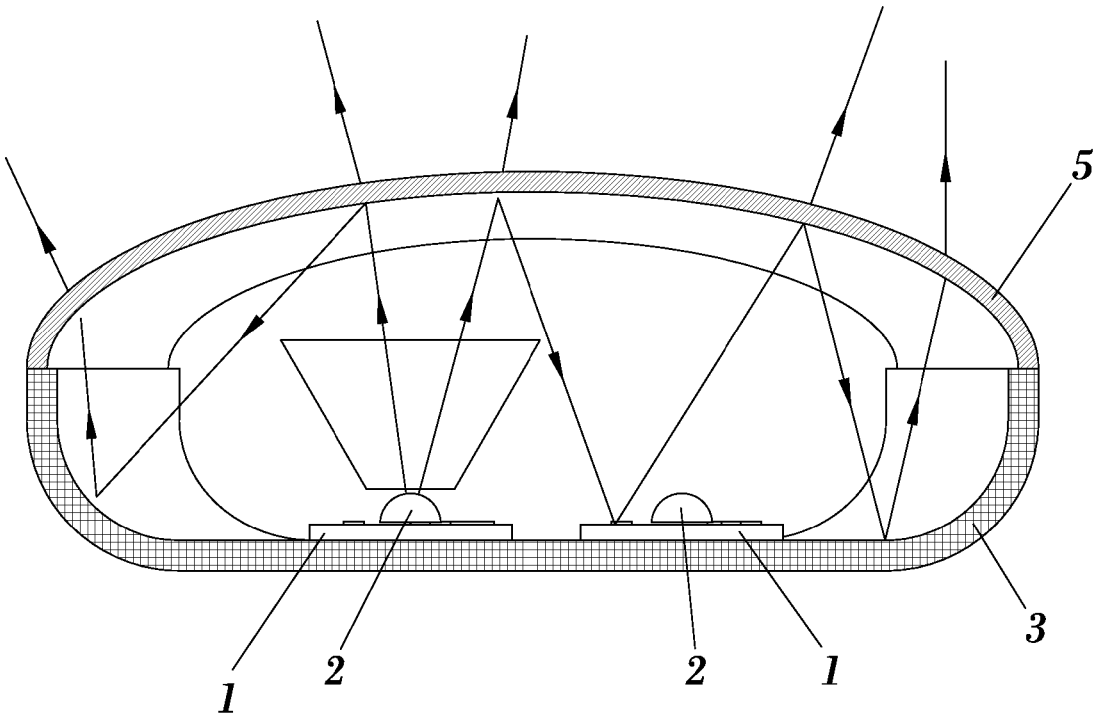
FIG. 2 shows a schematic two-dimensional view of the luminaire illustrated in FIG. 1, where the light beams and their different reflectance angles are seen.

In view of the described drawings, it can be seen how one of the possible embodiments of the luminaire with LED technology proposed by the invention comprises a power supply, wiring, a plurality of electronic components (7), a translucent or transparent closure (5), a protective housing (3) for the lighting system, a plurality of secondary optics (6) and an electronic base plate (1) having a plurality of LEDs (2), the luminaire being characterized in that it comprises three surfaces:

a first surface (4*a*) defined by the surface of the electronic base plate (1) and the electronic components (7) adjacent thereto, a second surface (4*b*) defined by the inner surface of the protective housing (3) comprised between the electronic base plate (1) and the transparent or translucent closure (5), and a third surface defined by the inner surface of the transparent or translucent closure (5), such that a thin film made of a highly reflective material is applied to at least 5% of the first surface and to at least 5% of the second surface.

The thin film made of a highly reflective material has a reflectance index of not less than 60% and has an average thickness of not more than 500 micrometers.

There is additionally a thin film made of standard protective material located between the electronic base plate (1) and between the thin film made of a highly reflective material.

In view of this description and set of drawings, the person skilled in the art will understand that the embodiments of the invention which have been described can be combined in many ways within the object of the invention. The invention has been described according to several preferred embodiments thereof, but for the person skilled in the art it will be evident that multiple variations can be introduced in said preferred embodiments without exceeding the object of the claimed invention.

The invention claimed is:

1. Luminaire with LED technology comprising a power supply, wiring, a plurality of electronic components, a translucent or transparent closure, a protective housing for the lighting system and at least one electronic base plate having a plurality of LEDs, the luminaire comprising:

a first surface formed by the surface of said at least one electronic base plate and the electronic components adjacent thereto, a second surface defined by the inner surface of the protective housing comprised between said at least one electronic base plate and the transparent or translucent closure, and a third surface defined by the inner surface of the transparent or translucent closure, wherein the first surface is attached to the second surface, a first coating made of a highly reflective material is applied to at least 5% of the first surface and to at least 5% of the second surface, and a second coating made of protective material located between said at least one electronic base plate and between the coating made of a highly reflective material to provide electric isolation.

2. Luminaire with LED technology according to claim 1, wherein the first coating made of a highly reflective material has a reflectance index of not less than 60%.

3. Luminaire with LED technology according to claim 1, wherein the first coat made of a highly reflective material has an average thickness of not more than 500 micrometers.

4. Luminaire with LED technology according to claim 1, wherein the first coating made of a highly reflective material has physicochemical characteristics protecting the components in contact therewith from oxidation and aging.

5. Method for obtaining a luminaire with LED technology, the method comprising the following steps:

providing a first surface formed by a surface of at least one electronic base plate with a plurality of LEDs and a plurality of electronic components adjacent thereto, providing a second surface defined by an inner surface of a protective housing for the lighting system comprised between the at least one electronic base plate and a transparent or translucent closure, attaching the first surface to the second surface, providing a third surface defined by an inner surface of the transparent or translucent closure, applying a first coating made of a highly reflective material to at least 5% of the first surface and to at least 5% of the second surface, applying a second coating made of protective material between said at least one electronic base plate and the first coating to provide electric isolation.

* * * * *